US007121789B2

(12) United States Patent
Richards

(10) Patent No.: US 7,121,789 B2
(45) Date of Patent: Oct. 17, 2006

(54) ARRANGEMENT FOR MOUNTING A NON-ROTATING COMPONENT

(75) Inventor: William Richards, Derby (GB)

(73) Assignee: Rolls-Royce plc, London (GB)

( * ) Notice: Subject to any disclaimer, the term of this patent is extended or adjusted under 35 U.S.C. 154(b) by 153 days.

(21) Appl. No.: 10/910,336

(22) Filed: Aug. 4, 2004

(65) Prior Publication Data

US 2005/0042085 A1 Feb. 24, 2005

(30) Foreign Application Priority Data

Aug. 8, 2003 (GB) ..... 0318609.5

(51) Int. Cl.
*F01D 25/24* (2006.01)

(52) U.S. Cl. ..... 415/173.1; 415/209.2; 415/209.3; 415/213.1

(58) Field of Classification Search ..... 415/173.1, 415/209.2, 209.3, 213.1, 214.1
See application file for complete search history.

(56) References Cited

U.S. PATENT DOCUMENTS 3,861,827 A * 1/1975 Peabody et al. ..... 415/209.2
4,145,626 A 3/1979 Aroshidze et al.
6,325,596 B1 12/2001 Tomko
6,641,326 B1 * 11/2003 Schilling et al. ..... 403/337

FOREIGN PATENT DOCUMENTS

GB 0 748 912 SP 5/1956

* cited by examiner

*Primary Examiner*—Ninh H. Nguyen
(74) *Attorney, Agent, or Firm*—W. Warren Taltavull; Manelli Denison & Selter PLLC

(57) ABSTRACT

An arrangement 22 for mounting a non-rotating component 28 of a gas turbine engine 10, defining a portion of a gas path of the gas turbine engine 10 comprising: a non-rotating component 28 having an opening 23 to a receptacle 25; and a fastener 30 for retaining the non-rotating component 28, comprising a neck portion 34 and a head portion 32, wherein the neck portion 34 of the fastener 30 extends through the opening 23 in the non-rotating component 28 and the head portion 32 is retained, at least partially, within the receptacle 25.

13 Claims, 4 Drawing Sheets

ARRANGEMENT FOR MOUNTING A NON-ROTATING COMPONENT

FIELD OF THE INVENTION

Embodiments of the present invention relate to an arrangement for mounting a non-rotating component. In particular, they relate to an arrangement for mounting a non-rotating component, defining a portion of a gas path, of a gas turbine engine.

BACKGROUND OF THE INVENTION

A non-rotating component, defining a portion of a gas path, of a gas turbine engine is used to help guide gas through the engine. A nozzle guide vane is one example of such a non-rotating component. Nozzle guide vanes help provide torque within a turbine assembly, helping to drive the turbine blades. As a consequence, a nozzle guide vane may experience a large pressure drop across its surface. This exerts a force on the mounting arrangement of the nozzle guide vane and may cause the nozzle guide vane to become displaced, thereby reducing the efficiency of the engine.

One way of mounting nozzle guide vanes is to use a number of supports and fasteners. A hook may be used to secure one (front) end of the nozzle guide vane to the turbine assembly casing thereby providing, at least, radial retention. Axial movement may be restricted through the use of a retaining ring, located at the opposite (rear) end of the nozzle guide vane. Circumferential movement may be restricted by securing the nozzle guide vane to the casing by using a bolt. When the engine is not in use, there is no gas flow and the rear of the nozzle guide vane may slip out of place. Currently, a flange is provided at the rear of the nozzle guide vane that abuts a flange on the casing and prevents the nozzle guide vane slipping radially out of place.

It would be desirable to improve the mounting arrangements for non-rotating components of a gas turbine engine.

SUMMARY OF THE INVENTION

According to one aspect of the present invention there is provided an arrangement for mounting a non-rotating component of a gas turbine engine, defining a portion of a gas path of the gas turbine engine comprising: a non-rotating component having an opening to a receptacle; and a fastener for retaining the non-rotating component, comprising a neck portion and a head portion, wherein the neck portion of the fastener extends through the opening in the non-rotating component and the head portion is retained, at least partially, within the receptacle.

The fastener may be a removable fastener. It may be removable from the gas turbine engine and from the non-rotating component.

According to another aspect of the present invention there is provided an arrangement for mounting a non-rotating component, defining a portion of a gas path, of a gas turbine engine, having an axis, comprising: a removable fastener for retaining a non-rotating component in at least a first direction, when the engine is in use, and in at least a second, different direction, when the engine is not in use.

A portion of a gas path, of a gas turbine engine may be a portion of a turbine assembly. The fastener may fasten the non-rotating component to a casing of the gas turbine engine, such as a casing of the turbine assembly. The non-rotating component may be a nozzle guide vane or a shroud segment. The pressure on a non-rotating component in the turbine assembly may be large depending upon, at least, the location of the non-rotating component within the turbine assembly and the operating condition of the engine. It is desirable that non-rotating components may remain fixed relative to the casing of the engine. Embodiments of the present invention may provide a secure arrangement for mounting a non-rotating component, such as a nozzle guide vane, within the turbine assembly.

The first direction may be a circumferential direction relative to the axis of the gas turbine engine. The second direction may be a radial direction relative to the axis of the gas turbine engine. Therefore, the removable fastener may retain the non-rotating component in at least two orthogonal directions.

The removable fastener may be removable from the gas turbine engine and may be removable from the non-rotating component.

The receptacle may be defined by at least two opposing sidewalls converging towards the opening.

The width of the head portion is greater than the width of the neck portion. The head portion may have an asymmetric shape, for example a dovetail shaped profile.

The fastener may provide a tenon of a tenon and mortise combination for retaining the non-rotating component. The receptacle may provide a mortise of a tenon and mortise combination for retaining the non-rotating component.

The neck portion of the fastener may have an interference collar. The interference collar may be used to provide retention of the fastener within the casing while the fastener is being attached to the casing, prior to the application of a nut. The interference collar may also provide a gas tight seal between the fastener and the casing. This feature may help to reduce unnecessary heating of the casing of the gas turbine engine due to leaked gas. This may therefore help to increase the efficiency of the gas turbine engine.

The head portion may have an upper surface that abuts the non-rotating component or alternatively the casing of the gas turbine engine. The abutting contact may provide retention of the non-rotating component in the radial direction. The prior art discloses flanges that may provide radial retention of the non-rotating component, however, according to embodiments of the present invention, they are not needed on the non-rotating component and on the casing and may be removed. This may reduce the weight of the non-rotating component and the weight of the casing, thereby improving the operating efficiency of the gas turbine engine.

The side walls of the head portion may abut the non-rotating component. The angle of convergence of the side walls defines the area of the side walls. If the pressure due to gas on the mounting arrangement is large, then the area of the side walls may be increased to reduce said pressure. This may increase the length of time in which the non-rotating component and the fastener may stay in service within the gas turbine engine.

The arrangement may further comprise a hook and a retaining ring. The hook may retain the non-rotating component in at least a second direction. The retaining ring may retain the non-rotating component in at least a third direction, which may be orthogonal to the first direction and to the second direction. The third direction may be axial relative to the axis of the gas turbine engine.

The preferred embodiments of the present invention provide the benefit that there may be a reduced number of fasteners and supports for the non-rotating component. This may facilitate the location of the non-rotating component during assembly and may therefore reduce assembly costs.

BRIEF DESCRIPTION OF THE DRAWING

For a better understanding of the present invention reference will now be made by way of example only to the accompanying drawings in which.

DETAILED DESCRIPTION OF THE INVENTION

Figure 1:
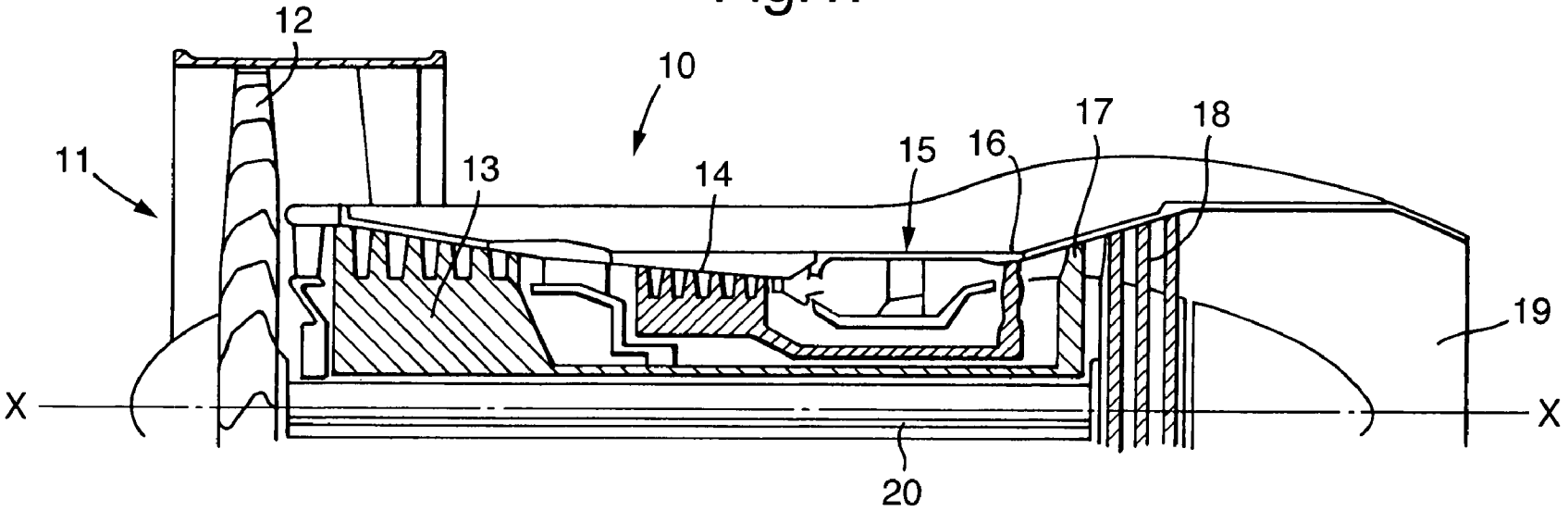
FIG. 1 illustrates a sectional side view of the upper half of a gas turbine engine.

The figures illustrate an arrangement 22 for mounting a non-rotating component 28 of a gas turbine engine 10, defining a portion of a gas path of the gas turbine engine 10 comprising: a non-rotating component 28 having an opening 23 to a receptacle 25; and a fastener 30 for retaining the non-rotating component 28, comprising a neck portion 34 and a head portion 32, wherein the neck portion 34 of the fastener 30 extends through the opening 23 in the non-rotating component 28 and the opening 23 retains the head portion 32 of the removable fastener 30, at least partially, within the receptacle 25.

FIG. 1 illustrates a sectional side view of the upper half of a gas turbine engine 10. The gas turbine engine 10 comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18 and an exhaust nozzle 19.

The gas turbine engine 10 operates in a conventional manner so that air entering in the intake 11 is accelerated by the propulsive fan 12 which produces two air flows: a first air flow into the intermediate pressure compressor 13 and a second air flow which provides propulsive thrust. The intermediate pressure compressor 13 compresses air flow directed into it for delivering air to the high pressure compressor 14 where further compression takes place. The compressed air exhausted from the high pressure compressor 14 is directed into the combustor 15 where it is mixed with fuel and the mixture is combusted. The resultant hot combustion products then expand and thereby drive the high, intermediate and low pressure turbines 16, 17, 18 before being exhausted through the nozzle 19 to provide additional thrust. The high, intermediate and low pressure turbines 16, 17, 18 drive the high and intermediate pressure compressors 14, 13 and the propulsive fan 12 by suitable interconnecting shafts 20.

Figure 2:
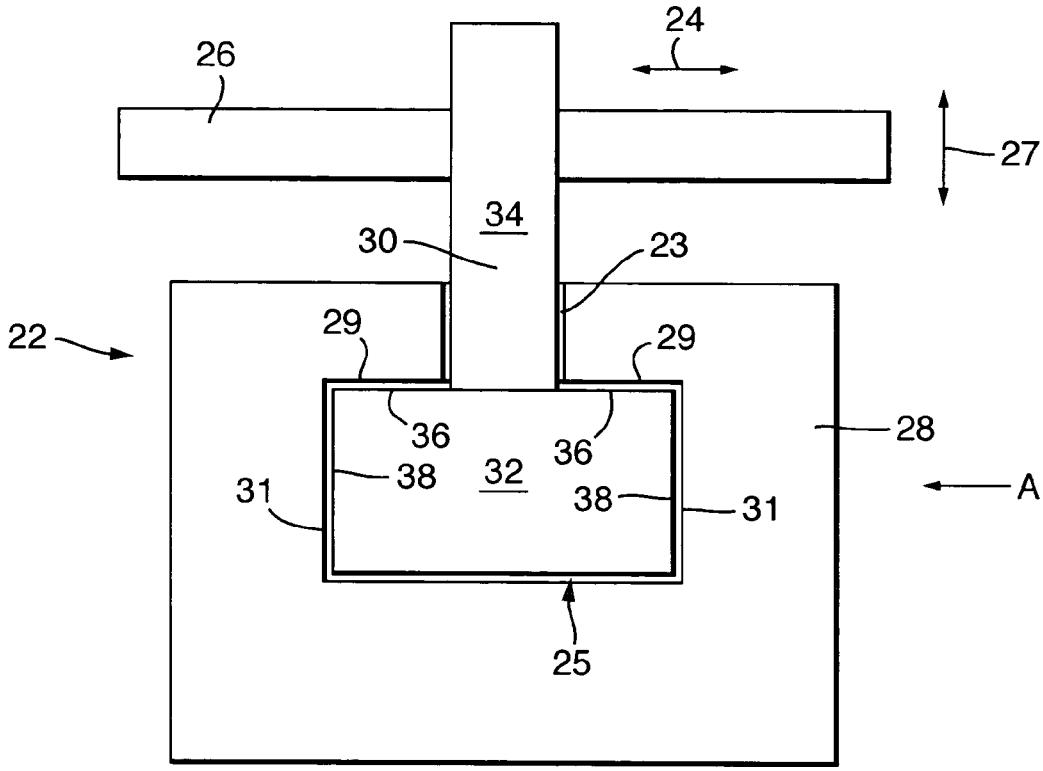
FIG. 2 illustrates a sectional front view of one embodiment of the present invention.

FIG. 2 illustrates an arrangement 22 for mounting a non-rotating component 28 of a gas turbine engine 10 according to one embodiment of the present invention. The non-rotating component 28 comprises a receptacle 25 having an opening 23. The arrangement 22 further comprises a fastener 30 that has a head portion 32 and a neck portion 34. The width of the head portion 32 is greater than the width of the neck portion 34. The receptacle 25 retains the head portion 32 and the neck portion 34 extends through the opening 23 and is secured to a casing 26 of the gas turbine engine 10 (discussed in greater detail with reference to FIG. 5). The non-rotating component 28 is thereby fastened to the casing 26 by the fastener 30.

The receptacle 25 comprises side walls 31 and an upper surface 29. The head portion 32 comprises side walls 38 and an upper surface 36. The side walls 31 of the receptacle 25 abut the side walls 38 of the head portion 32. The upper surface 29 of the receptacle 25 abuts the upper surface 36 of the head portion 32. Therefore, the head portion 32 fits snugly into the receptacle 25.

When the gas turbine engine 10 is not in use, the fastener 30 retains the non-rotating component 28 (against gravity) in a second direction indicated by arrow 27. This is provided by the abutting contact between the upper surface 29 of the non-rotating component 28 and the upper surface 36 of the fastener 30. When the gas turbine engine 10 is in use, the fastener 30 retains the non-rotating component 28 (against gas pressure) in a first direction indicated by arrow 24. The first direction 24 is orthogonal to the second direction 27. This is provided by the abutting contact between the side walls 31 of the non-rotating component 28 and the side walls 38 of the fastener 30.

Therefore, the fastener 30 and the non-rotating component 28 define a tenon and mortise combination. The fastener 30 is the tenon and the receptacle 25 acts as the mortise.

Figure 3:
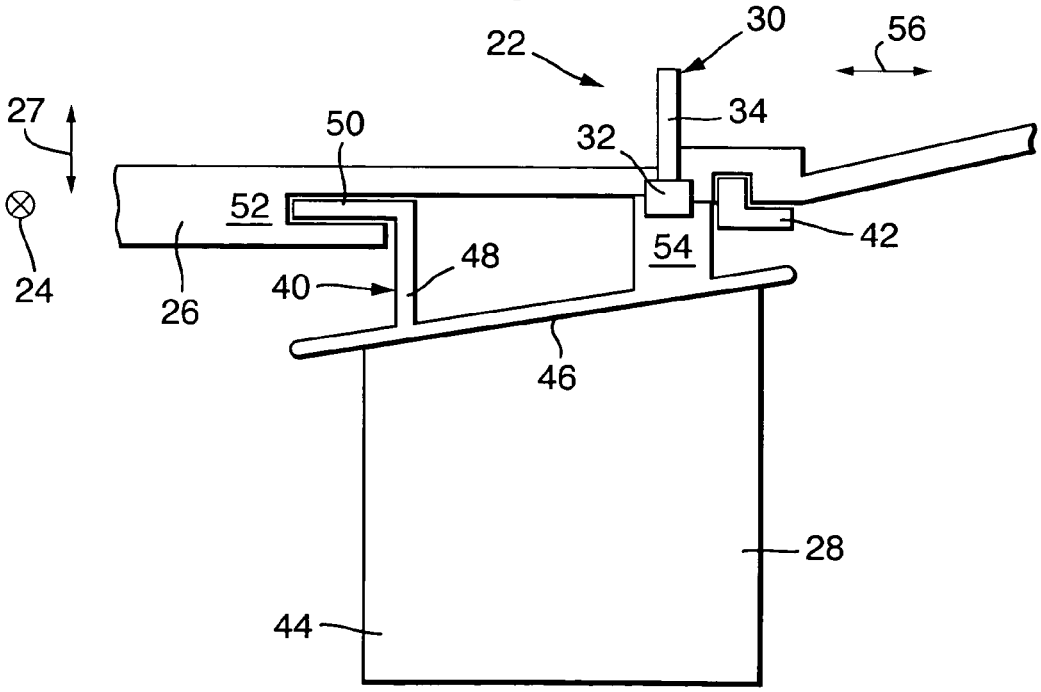
FIG. 3 illustrates the schematic diagram of FIG. 2 in a sectional side view.

FIG. 3 illustrates a more detailed diagram of the arrangement 22, viewed from direction A in FIG. 2. FIG. 3 illustrates additional supports and fasteners that may be used to retain a non-rotating component 28. The arrangement 22 comprises the fastener 30 as described in the preceding paragraphs with reference to FIG. 2. The arrangement 22 further comprises a hook 40 and a retaining ring 42 for retaining the non-rotating component 28 to the casing 26.

In this embodiment, the non-rotating component 28 is a nozzle guide vane. The nozzle guide vane 28 comprises a blade 44 for guiding gas, through the gas turbine engine 10 and an outer platform rail 46 connected to the blade 44.

The hook 40 is mounted on, or part of, the outer platform rail 46. The hook 40 is located at one end of the outer platform rail 46. The hook 40 comprises two portions (as illustrated in FIG. 3), a generally vertical portion 48 and a generally horizontal portion 50. The horizontal portion 50 of the hook 40 is, in use, slotted into a groove 52 of the casing 26. The nozzle guide vane 28 is retained in at least the second direction, indicated by arrow 27, by the hook 40.

The retaining ring 42 is located at the opposite end of the outer platform rail 46 to the hook 40. The retaining ring 42 is in abutting contact with the casing 26 and a portion 54 of the outer platform rail 46. The retaining ring 42 helps to prevent the hook 40 from slipping out of the groove 52. The retaining ring 42 has an L-shaped profile when viewed from direction A. The retaining ring 42 retains the nozzle guide vane 28 in a third direction, indicated by arrow 56. The third direction 56 is orthogonal to the first direction 24 and to the second direction 27.

Figure 4:
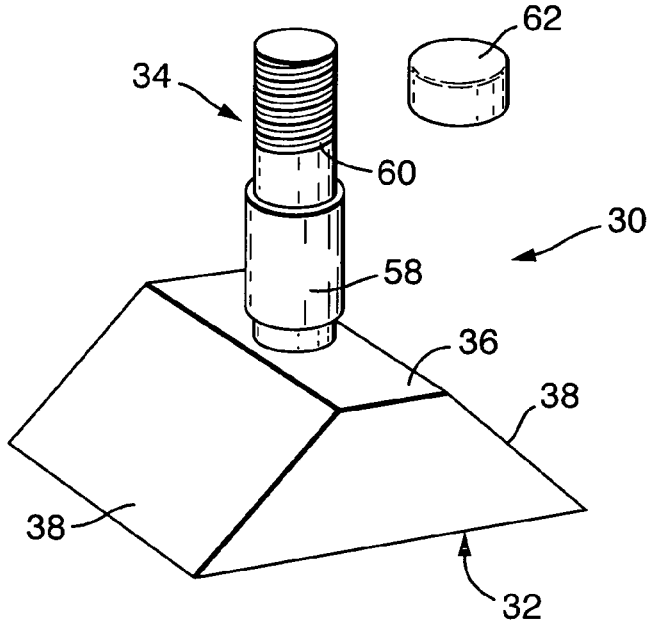
FIG. 4 illustrates a perspective view of one embodiment of a fastener.

FIG. 4 illustrates one embodiment of a fastener 30 for retaining a non-rotating component 28. The fastener 30 is, in this embodiment, removable from the non-rotating component 28 and the gas turbine engine 10. The removable fastener 30 comprises a head portion 32 and a neck portion 34. The head portion 32 has an upper surface 36 and side walls 38. The side walls 38 converge towards the upper surface 36 to form a dovetail shaped profile. The neck portion 34 is connected to, and extends perpendicularly out of the upper surface 36 of the head portion 32. An interference collar 58 is located at one end of the neck portion 34, close to the upper surface 36. A screw portion 60 is located at the opposite end of the neck portion 34. A nut 62 may be screwed onto the screw portion 60.

Figure 5:
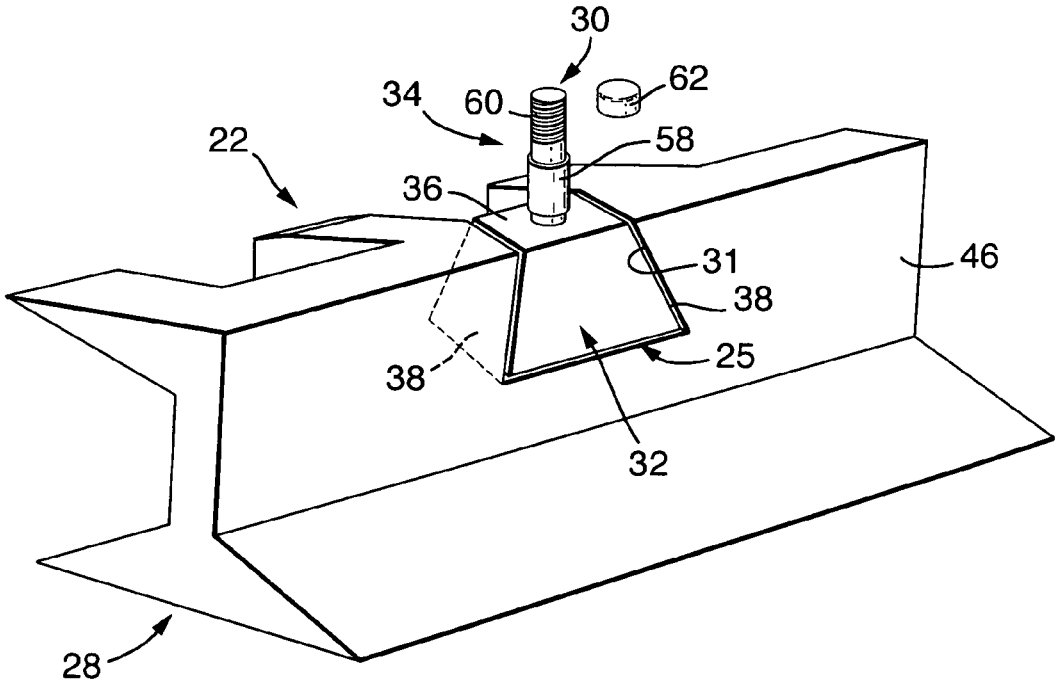
FIG. 5 illustrates a diagram of one embodiment of the present invention comprising the fastener illustrated in FIG. 4.

Reference will now be made to both FIG. 4 and FIG. 5 to describe the use of the removable fastener 30. FIG. 5 illustrates one embodiment of the removable fastener 30 illustrated in FIG. 4, retaining a non-rotating component 28 such as a nozzle guide vane 28.

In this embodiment, the outer platform rail 46 comprises a receptacle 25. The receptacle 25 performs a similar function to the receptacle 25 illustrated in FIG. 2. The head portion 32 of the removable fastener 30 is slid into the receptacle 25 of the outer platform rail 46. The side walls 38 of the removable fastener 30 abut the side walls 31 of the receptacle 25 and the head portion 32 is thereby retained in the receptacle 25.

The areas of the side walls 38 are defined by their convergent angle. The head portion 32 can be manufactured so that the area of the side walls 38 have a desired area. This may help reduce the pressure due to gas on the arrangement 22 at the abutting side walls 31 and 38.

A casing 26 of the gas turbine engine 10 (not shown in FIG. 5 for reasons of clarity) is placed over the neck portion 34 so that the neck portion 34 extends through the casing 26. The casing 26 is fixed by the interference collar 58. The nozzle guide vane 28 may be hung from the casing 26 by the contact between the casing 26 and the interference collar 58. The nut 62 is then placed on the neck portion 34 and screwed onto the screw portion 60 until contact is made with the casing 26. The nut 62 provides retention of the removable fastener 30 and thereby the nozzle guide vane 28 to the casing 26.

Figure 6:
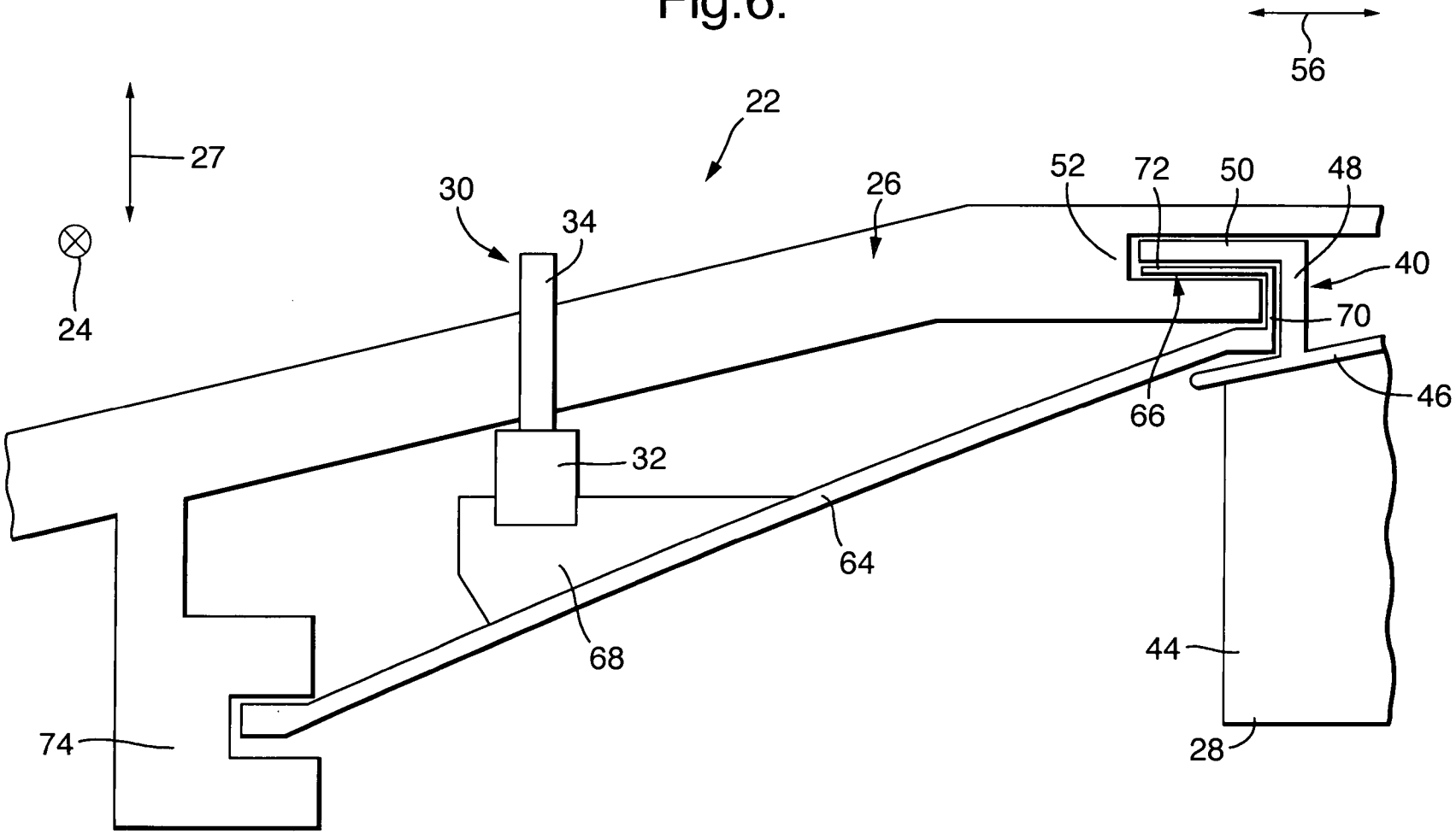
FIG. 6 illustrates a sectional side view of a second embodiment of the present invention.

FIG. 6 illustrates an alternative embodiment of an arrangement 22 for mounting a non-rotating component. FIG. 6 comprises some of the components illustrated in FIG. 3. In this embodiment, the non-rotating component 64 is a shroud segment. The shroud segment 64 is secured to the casing 26 by the fastener 30, in the same manner as described in the preceding paragraphs and with reference to FIGS. 2–5. The shroud segment 64 is also further retained by a groove 74 within the casing 26 and a hook 66 that is retained by a groove 52 in the casing 26.

The hook 66 is situated at one (rear) end of the shroud segment 64. The hook 66 comprises a generally vertical portion 70 and a generally horizontal portion 72 (as illustrated in FIG. 6). When the gas turbine engine 10 is not in use, the shroud segment 64 is retained, at least, by the hook 66. The hook 66 is slotted into the groove 52 of the casing. The vertical portion 70 abuts the vertical portion 48 of the hook 40 of the outer platform rail 46. The horizontal portion 72 abuts the casing 26 in the groove 52 and the horizontal portion 50 of the hook 40 of the outer platform rail 46. The hook 66 therefore fits snugly in the groove 52, thereby providing retention for the shroud segment 64 in at least a second direction 27.

The shroud segment 64 is also retained by a groove 74 in the casing 26 at the opposite end to the hook 66. The shroud segment 64 is in abutting contact with the groove 74, thereby providing retention for the shroud segment 64 in at least the third direction 56.

Although embodiments of the present invention have been described in the preceding paragraphs with reference to various examples, it should be appreciated that modifications to the examples given can be made without departing from the scope of the invention as claimed. For example, the head portion 32 may have any asymmetric shape so long as the width of the head portion 32 is greater than the width of the neck portion 34. The non-rotating component 28 may be any suitable non-rotating component within a gas turbine engine 10.

Whilst endeavoring in the foregoing specification to draw attention to those features of the invention believed to be of particular importance it should be understood that the applicant claims protection in respect of any patentable feature or combination of features hereinbefore referred to and/or shown in the drawings whether or not any particular emphasis has been placed thereon.

The invention claimed is:

1. An arrangement for mounting a non-rotating component of a gas turbine engine, defining a portion of a gas path of the gas turbine engine, comprising:

a non-rotating component having structure defining a receptacle, the receptacle having an opening; and a fastener for retaining the non-rotating component, comprising a neck portion and a head portion, wherein the neck portion of the fastener extends through the opening and the head portion is retained, at least partially, within the receptacle wherein the receptacle is defined by at least two opposing sidewalls converging towards the opening.

2. An arrangement as claimed in claim 1, wherein the gas turbine engine comprises a casing, and the fastener fastens the non-rotating component to a portion of the casing of the gas turbine engine.

3. An arrangement as claimed in claim 2, wherein the fastener extends through the casing.

4. An arrangement as claimed in claim 2, wherein the head portion of the fastener comprises a surface that, in use, abuts the casing of the gas turbine engine.

5. An arrangement as claimed in claim 1, wherein the head portion of the fastener has a dovetail shape.

6. An arrangement as claimed in claim 1, wherein the fastener provides a tenon of a tenon and mortise combination for retaining the non-rotating component.

7. An arrangement as claimed in claim 1, wherein the neck portion of the fastener comprises an interference collar.

8. An arrangement for mounting a non-rotating component, defining a portion of a gas path, of a gas turbine engine, having an axis, comprising:

a removable fastener for retaining a non-rotating component in at least a first direction, when the engine is in use, and in at least a second, different direction, when the engine is not in use wherein the second direction is radial, relative to the axis of the gas turbine engine.

9. An arrangement as claimed in claim 8, wherein the first direction is circumferential, relative to the axis of the gas turbine engine.

10. An arrangement as claimed in claim 8, wherein the removable fastener comprises a head portion and the non-rotating component comprises a receptacle for receiving and retaining, at least partially, the head portion.

11. An arrangement as claimed in claim 8, further comprising a first support for retaining the non-rotating component in the second direction, wherein the first support is a hook or a flange that abuts the casing of the gas turbine engine.

12. An arrangement as claimed in claim 8, further comprising a second support for retaining the non-rotating component in a third direction, wherein the second support is a retaining ring.

13. An arrangement as claimed in claim 8, wherein the non-rotating component is a nozzle guide vane of a gas turbine engine or a shroud segment of a gas turbine engine.

* * * * *